United States Patent [19]

Murakami et al.

[11] 3,977,176

[45] Aug. 31, 1976

[54] ELECTRONIC WATCH STRUCTURE

[75] Inventors: Tomomi Murakami, Higashi Yamato; Hiromichi Nagata, Higashi Murayamashi, both of Japan

[73] Assignee: Citizen Watch Co., Ltd., Tokyo, Japan

[22] Filed: Aug. 19, 1975

[21] Appl. No.: 605,921

[30] Foreign Application Priority Data

| | | |
|---|---|---|
| Aug. 22, 1974 | Japan | 49-096335 |
| Oct. 15, 1974 | Japan | 49-117712 |
| Sept. 18, 1974 | Japan | 49-106788 |
| Dec. 3, 1974 | Japan | 49-138667 |

[52] U.S. Cl. ..... 58/23 BA; 58/23 R; 58/55; 58/88 R; 58/90 R; 224/4 C

[51] Int. Cl.[2] ..... G04C 3/00; G04B 37/07; A44C 5/02

[58] Field of Search ..... 58/23 R, 23 BA, 50 R, 58/53–55, 88 R, 90 R; 224/4 C

[56] References Cited

UNITED STATES PATENTS

| | | | |
|---|---|---|---|
| 3,032,651 | 5/1962 | Stahli et al. | 58/23 BA |
| 3,712,047 | 1/1973 | Girard | 58/50 R |
| 3,729,923 | 5/1973 | Brigliano et al. | 58/23 BA |
| 3,846,971 | 11/1974 | Ho et al. | 58/50 R |
| 3,863,436 | 2/1975 | Schwarzschild | 58/50 R |

*Primary Examiner*—E. S. Jackmon
*Attorney, Agent, or Firm*—Spensley, Horn & Lubitz

[57] ABSTRACT

An electronic watch structure comprising separate molded plastic rectangular packages for the electronic watch movement and for the battery. The separate packages are mechanically and electrically connected together. The electronic watch movement package comprises two rectangular molded plastic halves having recesses, projections and hooks molded therein to hold the associated elements of the electronic watch movement in place. The movement package also includes a rectangular packing clamped between the halves of the package to form a waterproof seal. Furthermore, the battery in the battery package is electrically coupled to the electronic watch movement by conductive rubber composition members.

3 Claims, 32 Drawing Figures

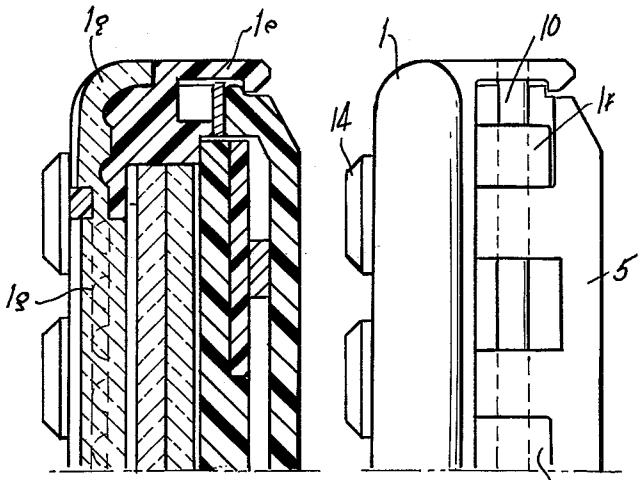
FIG-5
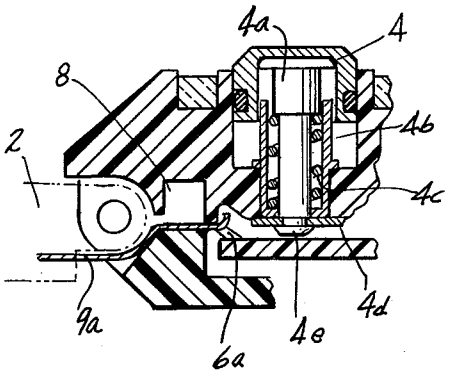
FIG-6
FIG-7
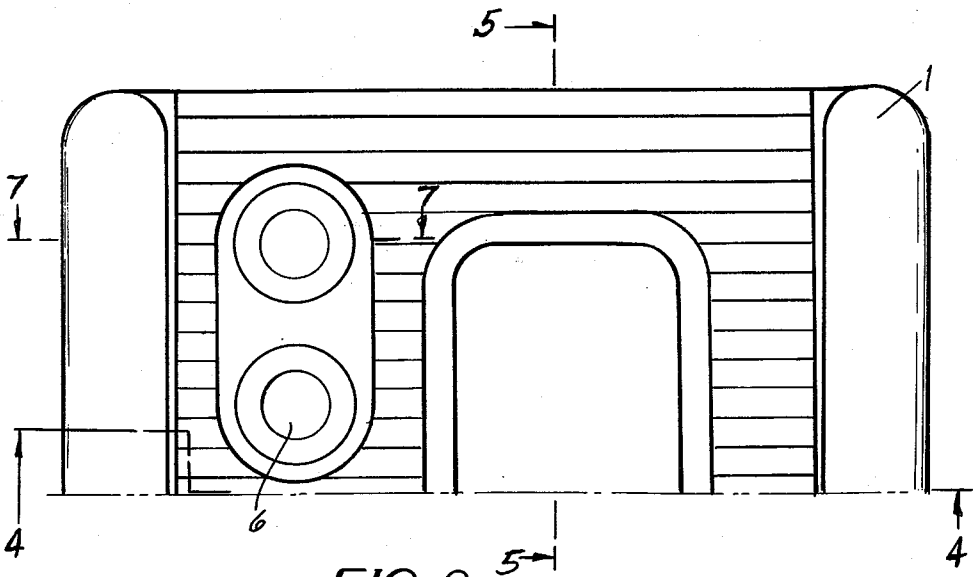
FIG-3
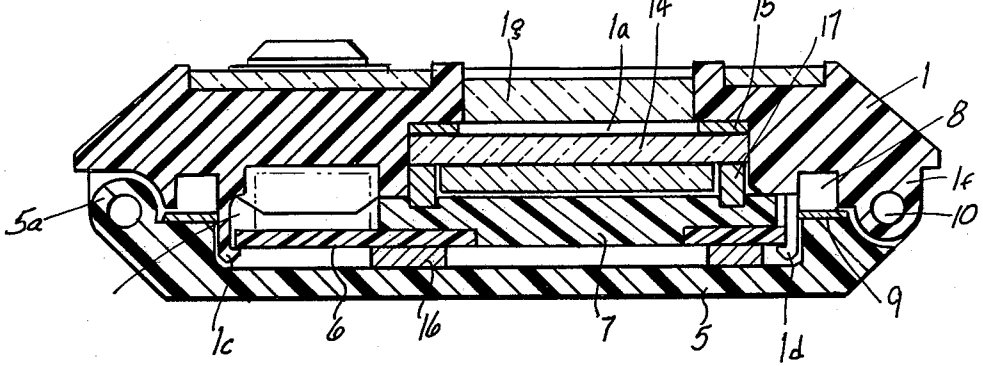
FIG-4

15
14
17
17
7
7a
6c
6
6b
16

ELECTRONIC WATCH STRUCTURE

BACKGROUND OF THE INVENTION

1. Field of the Invention

This invention relates to the construction of electronic timepieces and in particular the complete structure of an electronic timepiece.

2. Prior Art

In recent years, the modularization of the elements with which electronic watches are constructed has progressed to the extent that the number of structural elements have been substantially reduced. Conventional electronic watches are built with a fixed base plate having the elements of the movement mounted thereon and the base plate together with the elements of the movement fitted into a watchcase. In such a watch, there arises a necessity for parts that make up each element of the movement and as a result the number of individual parts has become unusually large. In addition, with the advent of plastic molding techniques, watchcases have been fabricated by injection molding. Such watchcases have been fabricated with tubules for affixing the movement to the watchcase by screws. However, the assembly of such a watch by screws involves a substantial amount of work and expense. In an effort to produce electronic watches as cheaply as possible, methods utilizing the tubules for affixing the watch movement to the watchcase without screws have been considered.

Since most of the elements that make up an electronic watch movement are substantially rectangular, round cases make an inefficient use of the available space within the watch. In an attempt to overcome this problem in a round watch, rectangular watchcases have been injection molded from plastic. However, rectangular watchcases have had several difficulties in the past. The major difficulty is providing waterproof protection for the electronic watch movement in the rectangular case. In particular, when the watchcase is made of a dry-nature plastic material, it is more easily distorted than metal due to the elasticity and other properties of the plastic. Since the case made out of a dry-nature plastic material easily distorts, the tightness of the seal is unsatisfactory and waterproofing is not completely effected.

Also, in order to make the electronic watch as small as possible, the battery is separated from the watch proper and is moved outside of the watchcase. Moving the battery outside the watchcase raises new problems of its own and aggravates some of the old ones. In particular, a means must be provided for connecting the battery to the movement of the electronic timepiece. Said means must pass through both the container for the battery and the watchcase itself without effecting the watertightness of either.

SUMMARY OF THE INVENTION

In keeping with the principles of the present invention, the objects are accomplished by a unique plastic injection molded rectangular watchcase structure. The watchcase is molded in two halves and has recessed, projections, and hooks molded therein to provisionally hold the elements of the electronic watch in place. To effect the waterproofing, a rectangular packing is clamped between the two halves of the molded watchcase, thereby forming a watertight seal. Furthermore, the two halves of the watchcase are coupled together by an interlocking tab and hook at one end and a pin at the other end.

The battery is housed in a plastic injection molded housing and is mechanically coupled to the watchcase by a watchband link. Furthermore, the battery is electrically coupled to the electronic watch movement within the watchcase by flexible rubber composition conductors extending between the watchcase and the battery housing and through the watchband link. In addition, the rubber composite conductors are formed integrally at one end with the waterproofing packing and thereby do not have adverse effect upon the watertight seal of the watchcase.

Accordingly, it is a general object of the present invention to provide rectangular, plastic, injection molded watchcase and battery holder.

It is another object of the present invention to provide a simplified watchcase and battery housing having a reduced number of parts.

It is still another object of the present invention to provide a watchcase and battery housing wherein the number of work steps and the amount of assembly work is required is minimized.

It is yet another object of the present invention to provide an inexpensive plastic injection molded watchcase and battery housing.

It is also an object of the present invention to provide a waterproof rectangular plastic watchcase and battery housing.

BRIEF DESCRIPTION OF THE DRAWINGS

The above-mentioned and other features and objects of the present invention will become more apparent by reference to the following description taken in conjunction with the accompanying drawings, wherein like reference numerals denote like elements, and in which:

FIG. 3 is a large scale simplified half plan view of a watchcase in accordance with the principles of the present invention;

FIG. 4 is a section of the watchcase of FIG. 3 along the 4—4 line;

FIG. 5 is a sectional view of the watchcase of FIG. 3 along the 5—5 line;

FIG. 6 is a half plan lateral view of the watchcase of FIG. 3;

FIG. 7 is a sectional view of the watchcase of FIG. 3 along the 7—7 line;

DESCRIPTION OF THE PREFERRED EMBODIMENT

Figure 1:
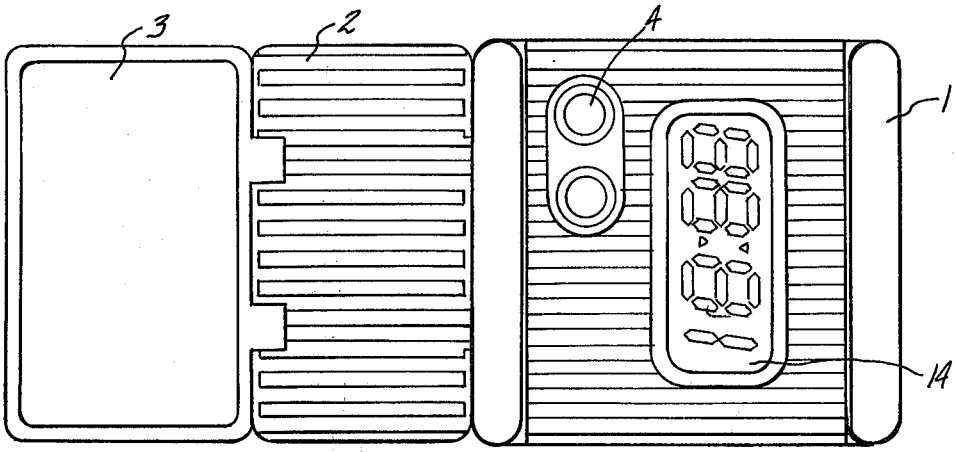
FIG. 1 is a plan view of a electronic timepiece in accordance with the teachings of the present invention.
Figure 2:
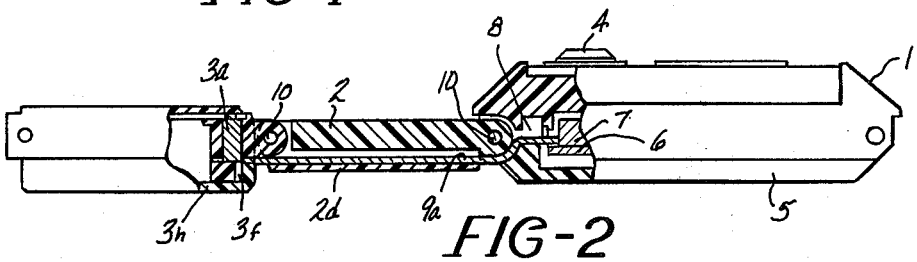
FIG. 2 is a lateral section of the electronic watch of FIG. 1.
Figure 26:
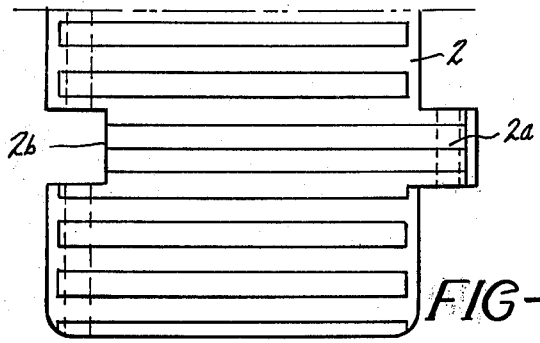
FIG. 26 is a plan views of a wristband link in accordance with the teachings of the present invention shown as a symmetrical half plan.
Figure 30:
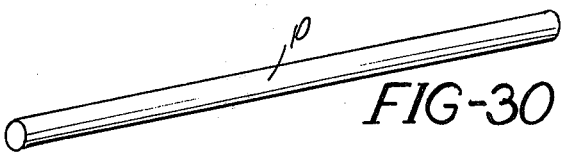
FIG. 30 is a pictorial view of a securing pin used either for holding the two halves of the watchcase together or for connecting the wristband links togeher.

FIGS. 1 and 2 illustrate an overview of an embodiment of a watchcase, wristband link and battery case in accordance with the teachings of the present invention. In the Figures, watchcase 7 is coupled to wristband link 2 by a pin 10 (shown in FIG. 30) which also couples together back lid 5 and watchcase 1. Two electric conductive rubber composites 9*a* extend through and under back cover 2*d* of band link 2 and electrically couples battery 3*c* within battery case 3 to the electronic watch movement contained within watchcase 1. Circular back lid 3*h* of battery case 3 together with packing 3*f* is pressed into and seals the back of battery case 3. A packing 8 is clamped between watchcase 1 and back lid 5, thereby forming a waterproof seal. A liquid crystal cell 14, and integrated circuit plate 7 and a circuit board 6 are housed in watchcase 1.

Referring to FIGS. 4, 5, 6 and 7, shown therein is the structure of an electronic watch in accordance with the teachings of the present invention. The watchcase 1 includes a packing 15 and liquid crystal cell 14 contained within liquid crystal cell positioning section 1*a* of watchcase 1. Connector 17 is inserted into opposite sides of positioning section 1*a* and forms an electrical connection between liquid crystal cell 14 and IC circuit plate 7. The square projection on the back of integrated circuit plate 7 is inserted into the square hole 6*b* in integrated circuit board 6. Circuit board 6, together with integrated circuit plate 7 are placed in the base plate positioning section 7*b* of watchcase 1. Circuit board 6 is held in place by the provisional securing tabs 1*c* and 1*d* of watchcase 1.

Figure 24:
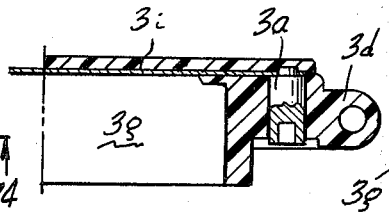
FIG. 24 is a sectional view of the underside of the battery case of FIG. 22 along the 24—24 line.
Figure 25:
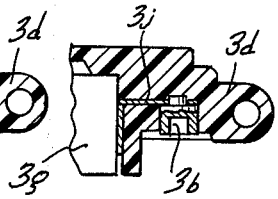
FIG. 25 is a cross-sectional view of the other contact similar to the sectional view of FIG. 24.

One end of electrically conductive rubber composites 9*a* of the packing 9 of watchcase 1 is connected to the battery 3*c* through the connecting points 3*a* and 3*b* (see FIGS. 24 and 25) of battery case 3 via the wristband link 2. The other end of conductive rubber composites 9*a* is compressed against the metal contact plate 6*a* (see FIG. 7) of circuit board 6.

In this provisionally secured position, adjustment and inspection of the watch may be carried out. Finally, watchcase 1 is assembled to back lid 5 by pin 10 which extends through the hole in external projection 5*a* on back lid 5 and external projection 1*f* in watchcase 1. On the side of watchcase 1 where there is no pin, the watchcase 1 is equipped with a tab 1*e* which engages with shoulder part 5*b* of back lid 5.

Operation of the completed watch from the outside may be accomplished by two pushbuttons 4, the structure of which is shown in FIG. 7. Switching contact 4*e* is welded to pushbutton shaft 4*a*. Switching spring 4*c* is inserted between collar 4*b* and the shoulder of pushbutton shaft 4*a*. Metal shop ring 4*d* is coupled to the bottom end of pushbutton shaft 4*a*. When the pushbuttons 4 are pushed, the switching operation is accomplished by connecting two contacts (not shown on the Figures) together on the circuit board 6 by the switching contact 4*e*.

Figure 31:
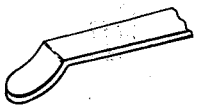
FIG. 31 is an enlarged partial view of the end of a lead in the IC base plate.
Figure 27:
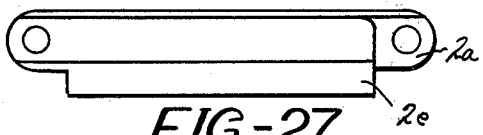
FIG. 27 is a side view of the wristband link of FIG. 26.
Figure 29:
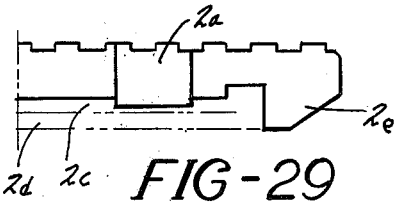
FIG. 29 is a side view of the wristband link of FIG. 26 shown symmetrically.
Figure 28:
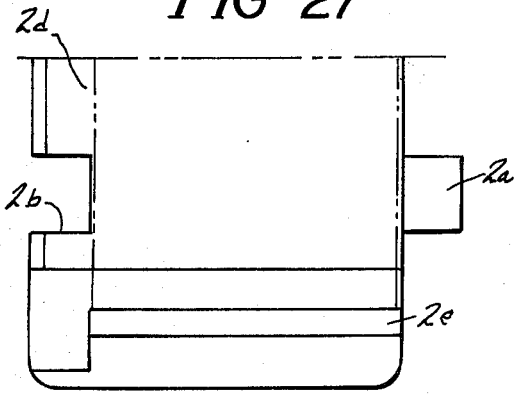
FIG. 28 is a bottom view of the wristband link of FIG. 26 shown symmetrically.
Figure 8:
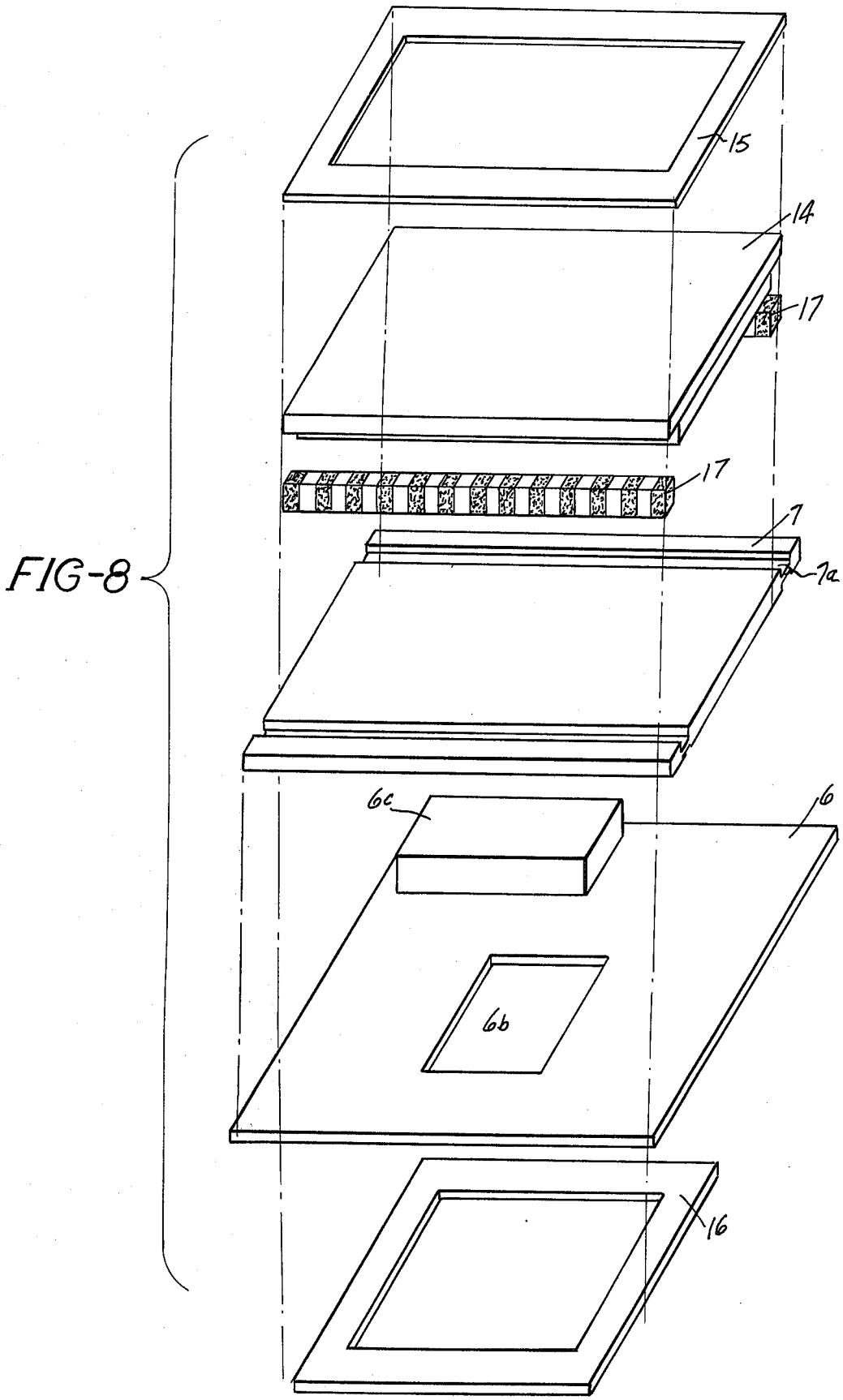
FIG. 8 is an exploded view of the main components of the internal elements of the watchcase shown in FIG. 4.

Referring to FIG. 8, shown therein is an exploded view of the main components of the internal elements of the electronic watch. Packing 15 is a narrow rectangular frame which is inserted between liquid crystal element 14 and the watchcase 1 to provide a cushioning effect. The liquid crystal cell 14 is composed of an upper glass and a bottom glass, the bottom glass being slightly smaller than the upper glass. Between the upper and bottom glasses are placed and sealed transparent electrical poles and a liquid crystal material in a manner well-known in the art. Electrical contacts coupled to the transparent electric poles are provided on the underside of the upper glass of liquid crystal cell 14. Connector 17 which is a rectangular pillar of multi-layered alternating electric conductive rubber composite and insulating rubber material engages against the underside of the upper glass of liquid crystal cell 14 and the channel section 7*a* in integrated circuit plate 7. Integrated circuit plate 7 is molded from insulating plastic and has a plurality of electrical leads molded into said plate. An IC chip not shown is attached to the underside of integrated circuit plate 7. The leads in integrated circuit plate 7 and the terminals of the IC chip are connected and sealed in plastic. This seal forms the rectangular shape projection on the bottom of integrated circuit plate 7. The ends of the leads are bent as shown in FIG. 31 and are constructed so as to be in contact with contact points (not shown) on circuit plate 7. The ends of the leads are exposed in channel section 7*a* of circuit plate 7 and are connected to the terminals on the underside of the upper glass of liquid crystal cell 14 by connector 17. Circuit board 6 has mounted thereon a crystal oscillator, a transducer, and other elements which are contained within the sealed block 6c. Circuit board 6 has wiring thereon (not shown). Packing 16 similar to packing 15 engages against the undersurface of circuit board 6.

Figure 9:
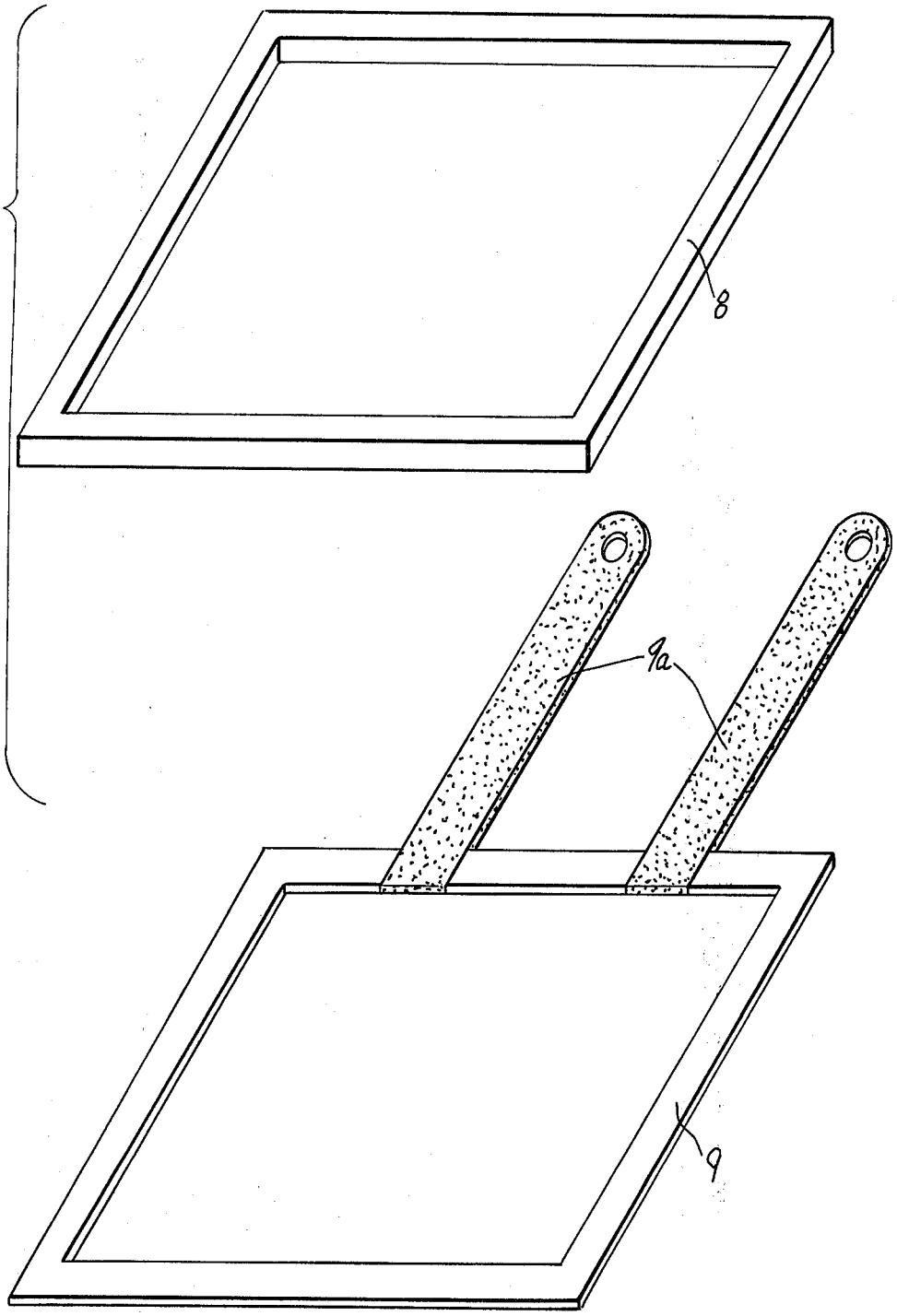
FIG. 9 is a pictorial view of the packing shown in FIG. 4.
Figure 10:
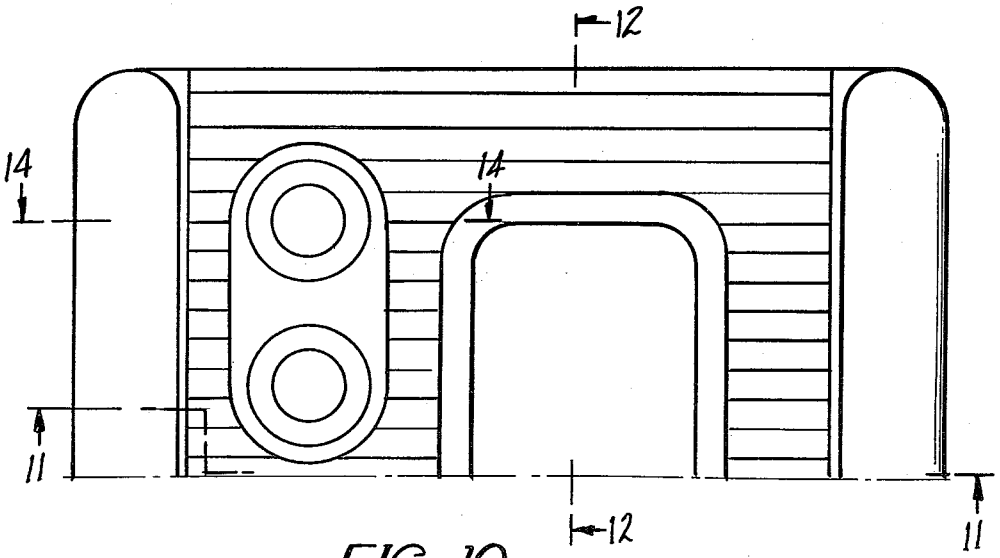
FIG. 10 is a large scale half plan view of a watchcase in accordance with the principles of the present invention.
Figure 12:
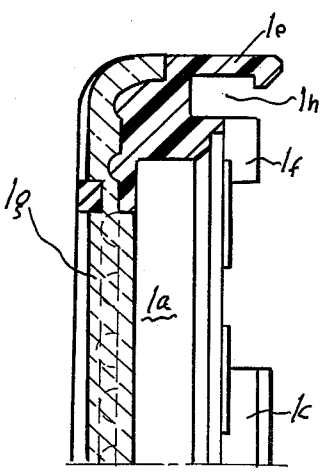
FIG. 12 is a sectional view of the watchcase of FIG. 10 along the 12—12 line.
Figure 13:
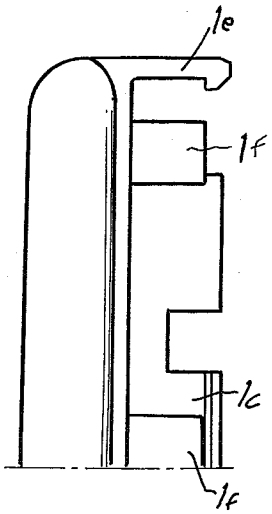
FIG. 13 is a lateral view of the watchcase of FIG. 10 shown as a symmetrical half plan.
Figure 14:
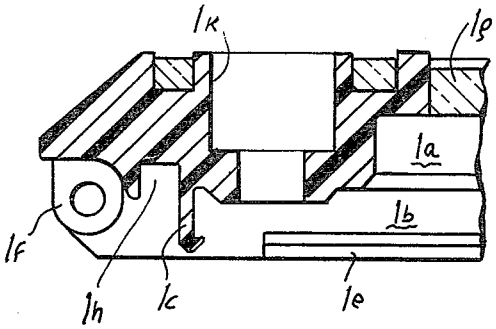
FIG. 14 is a sectional view of the watchcase of FIG. 10 along the 14—14 line.
Figure 11:
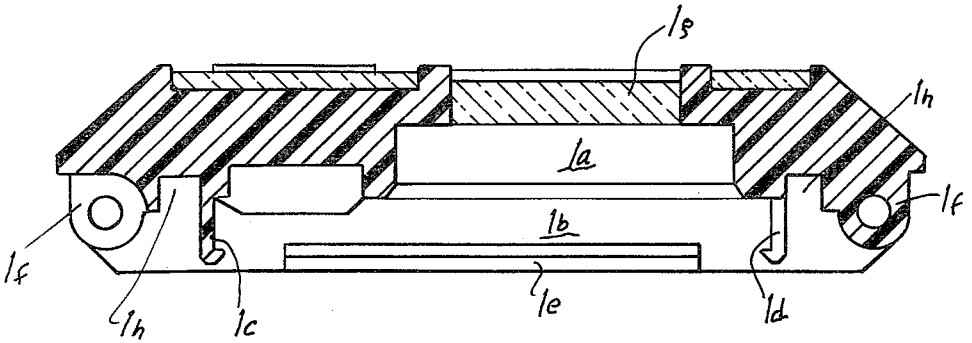
FIG. 11 is a sectional view of the watchcase of FIG. 10 along the 11—11 line.
Figure 15:
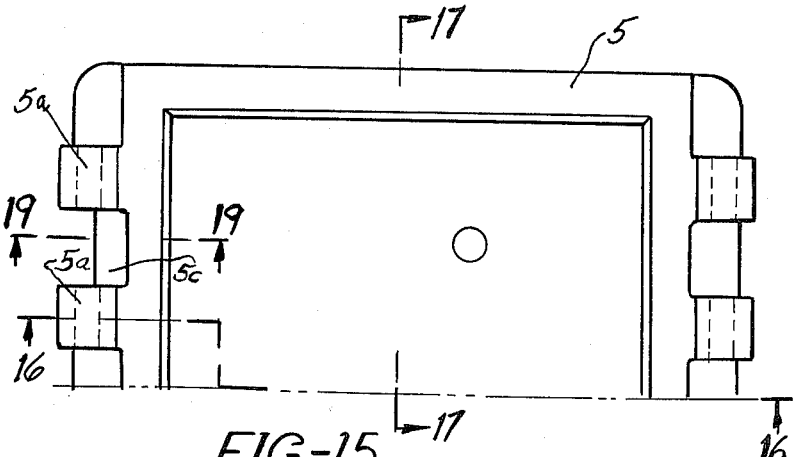
FIG. 15 is a plan view of a back cover of a watchcase in accordance with the principles of the present invention shown as an almost symmetrical half plan.
Figure 17:
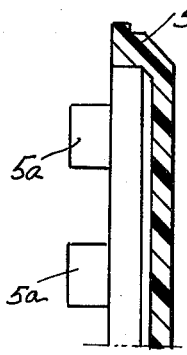
FIG. 17 is a sectional view of the back cover of FIG. 15 along the 17—17 line, shown as a symmetrical half plan.
Figure 18:
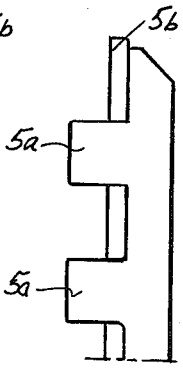
FIG. 18 is a side view of the back cover of FIG. 15 shown as a symmetrical half plan.
Figure 16:
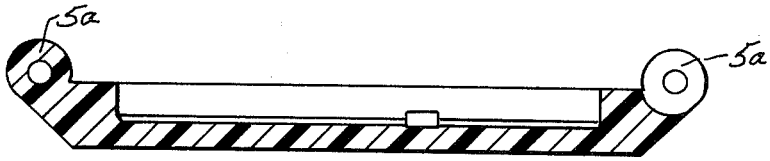
FIG. 16 is a sectional view of the back cover of FIG. 15 along the 16—16 line.
Figure 19:
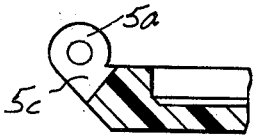
FIG. 19 is a sectional view of the back cover of FIG. 15 along the 19—19 line.
Figure 20:
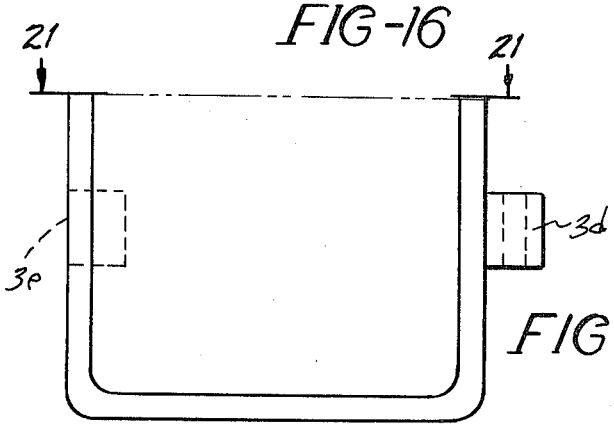
FIG. 20 is a plan view of a battery case in accordance with the teachings of the present invention shown as a symmetrical half plan.
Figure 21:
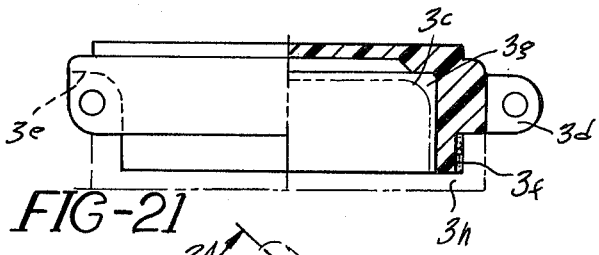
FIG. 21 is a sectional view of the battery case of FIG. 20 along the 21—21 line wherein the half plane view is a side view of Fig. 20.
Figure 23:
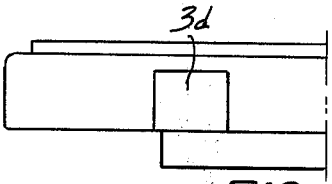
FIG. 23 is a side view of the battery case of FIG. 20 shown as a symmetrical half plan.
Figure 22:
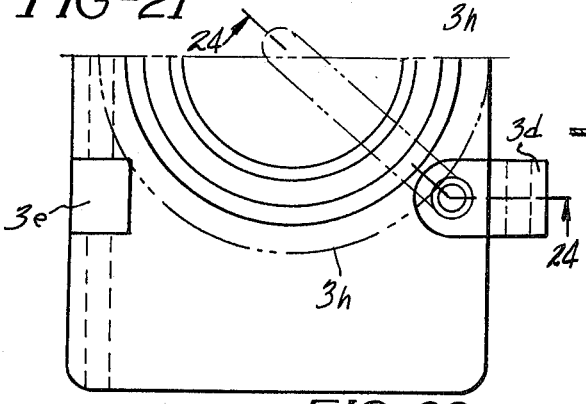
FIG. 22 is a bottom view of the battery case of FIG. 20 shown as a symmetrical half plan.

Referring to FIG. 9, shown therein is a pictorial view of the packing for waterproofing the watchcase. Packing 8 is a rectangular frame-like waterproof packing whose cross-sectional areas are substantially rectangular. Packing 9 is a thin rectangular shaped insulating packing with two electric conductive rubber composites 9a molded therein. Packing 9 is formed in a manner similar to that disclosed in the commonly assigned Tomomi Murakami, et al. application for U.S. letters patent Ser. No. 579,005.

Referring to FIGS. 10, 11, 12, 13 and 14, shown therein is a watchcase 1 in accordance with the teachings of the present invention. One piece molded transparent part 1g is inserted into watchcase 1 directly over the liquid crystal cell positioning chamber 1a. The watchcase 1 further comprises a base plate positioning chamber 1b, a waterproof packing positioning section 1h into which packing 8 and 9 rest and a switch positioning section 1k.

Referring to FIGS. 15, 16, 17, 18 and 19, shown therein is a back lid 5 in accordance with the teachings of the present invention. Back lid 5 comprises a single plastic rectangular injection molded piece. Back lid 5 has a projection 5a to allow the back lid 5 to be assembled to the watchcase 1 by means of a pin 10. A shoulder part 5b which engages with tab 1e of watchcase 1 is provided on the side of back lid 5 opposite to projection 5a. The back lid 5 also has channel sections 5c molded therein for allowing the electrically conductive rubber composite 9a of the waterproof packing 9 to extend out of the case 1.

Referring to FIGS. 20, 21, 22, 23 and 24, shown therein is a battery case 3 in accordance with the teachings of the present invention. Battery case 3 is molded in one piece and has metal pieces 3a and 3b inserted therein. The two ends of each of the metal pieces 3a and 3b are in contact respectively with the battery 3c and the electrically conductive rubber composite 9a. Battery case 3 also has a projection 3d molded thereon to enable said battery case 3 to be coupled to a wristband link by means of a pin 10. The battery case 3 further has a concave part 3e and battery chamber 3g. Round battery lid 3e together with a waterproofing packing 3h whose cross-sectional area is rectangular are pressed onto the bottom of battery case 3. Metal strip 3i in the top of battery chamber 3g is connected at one end to metal piece 3a. Bent metal piece 3j in the side of battery chamber 3g is connected at one end to metal piece 3b. Battery lid 3h not only compresses the waterproof packing 3f but also compresses the electric conductive rubber composite 9a against the metal pieces 3a and 3c of battery case 3 thereby forming an electrical connection.

Referring to FIGS. 26, 27, 28 and 29, shown therein is a wristband link 2 in accordance with the teachings of the present invention. Wristband link 2 is coupled between watchcase 1 and battery case 3. Wristband link 2 has a projection 2a to enable it to be coupled to the watchcase 1 by means of a pin 10. The wristband link 2 further has a concave part to allow the wristband link 2 to be coupled to the projection 3d of battery case 3 by a pin 10. Flexible tabs 2e are molded into the bottom surface of link 2. Wristband link lid 2d is held in place by flexible tabs 2e in the bottom of wristband link 2. Passageway 2c for electrically conductive rubber composite 9a is formed by wristband link lid 2d, flexible tabs 2e and the bottom surface of link 2.

Figure 32:
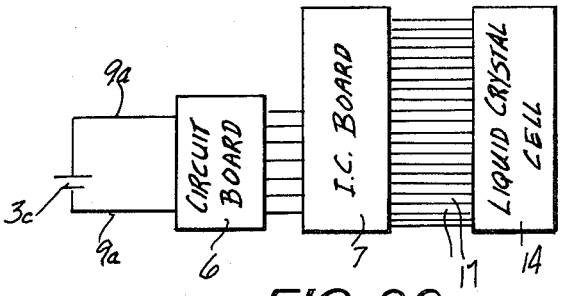
FIG. 32 is a block diagram of an electronic watch circuit housed in the watchcase and battery case.

Referring to FIG. 32, therein is shown a block diagram of a circuit of an electronic timepiece in accordance with the teachings of the present invention. Battery 3c is coupled to circuit board 6 by electrically conductive rubber composites 9a. Surface board 6 includes a crystal oscillator of standard configuration and a fine-tuning condenser for adjusting the frequency of the crystal oscillator. Integrated circuit plate 7 is electrically coupled to liquid crystal cell 14 by connector 17.

In all cases it is understood that the above-described embodiments are merely illustrative of but a small number of the many possible specific embodiments which can represent applications of the principles of the present invention. Numerous and varied other arrangements can be readily devised in accordance with these principles by those skilled in the art without departing from the spirit and scope of the invention.

We claim:

1. A watchcase for components of a digital electronic watch movement comprising:

a rectangular upper half, said upper half being injection molded in plastic, said upper half having internal positioning sections, recess and hooks molded therein for positioning and provisionally holding the components of said electronic watch movement in said upper half, whereby said components are easily disposed and held within said upper half, said upper half further having an elongated opening molded therein and external coupling projections molded thereon;

a back lid, said lid being injection molded in plastic and having external coupling projections molded thereon, said upper half being disposed on said back lid such that said external coupling projections on each are in an adjacent spaced apart configuration;

an elongated plastic transparent piece, said piece being fixed in said elongated opening;

a pin, said pin being inserted through at least one adjacent pair of external coupling projections on said upper half and said back lid; and a resilient rectangular packing member, said packing member having at least one arm member made from a resilient, conductive flexible material, said arm member being coupled at one end thereof to said packing member and extending outwardly from said packing member, said packing member being clamped between said upper half and said back lid, whereby said arm member outwardly extends from said watchcase.

2. The watchcase according to claim 1 further comprising:

a watchband link, said link being injection molded in plastic, said link having a passage for said arm members extending from said packing member to extend through, said link further having coupling projections molded onto opposing edges of said link;

an external battery case, said case being injection molded in plastic, said battery case having a battery chamber molded therein for holding at least one battery, said battery case further having means for electrically coupling the electrical poles of said battery to the exterior of said battery case, said battery case also having coupling projections molded onto the opposing edges of said battery case;

a battery case lid, said lid being injection molded in plastic, said lid being pressed onto the bottom of said battery chamber and pressing the extending ends of said arm members against the external end of said electrical coupling means in said case thereby forming an electrical connection between said battery case and said watchcase; and a pin, said pin being inserted through at least one adjacent pair of coupling projections in said link and said battery case.

3. A watchcase according to claim 2 wherein said arm members are made from an electrically conductive rubber composite.

* * * * *